United States Patent [19]

Ausnit

[11] Patent Number: 4,586,319

[45] Date of Patent: May 6, 1986

[54] METHOD OF AND MEANS FOR EASY OPENING BAGS

[75] Inventor: Steven Ausnit, New York, N.Y.

[73] Assignee: Minigrip, Inc., Orangeburg, N.Y.

[21] Appl. No.: 620,836

[22] Filed: Jun. 15, 1984

Related U.S. Application Data

[63] Continuation-in-part of Ser. No. 430,944, Sep. 30, 1982, Pat. No. 4,479,244.

[51] Int. Cl.[4] ..... B65B 3/04

[52] U.S. Cl. ..... 53/468; 53/384

[58] Field of Search ..... 53/468, 384, 385, 386, 53/492; 493/214

[56] References Cited

U.S. PATENT DOCUMENTS

| | | | |
|---|---|---|---|
| 3,190,049 | 6/1965 | Van Der Meulen | 53/468 X |
| 3,699,746 | 10/1972 | Titchenal et al. | 53/187 |
| 3,744,211 | 7/1973 | Titchenal et al. | 53/29 |
| 3,746,057 | 7/1973 | Titchenal | 53/384 X |
| 3,751,875 | 8/1973 | Membrino | 53/180 |
| 4,162,602 | 7/1979 | Achelpohl et al. | 53/415 |
| 4,169,345 | 10/1979 | Douwenga | 53/570 |
| 4,333,299 | 6/1982 | Hamilton | 53/450 |
| 4,387,550 | 6/1983 | Lerner | 53/459 |
| 4,423,583 | 1/1984 | Carey | 53/373 |
| 4,490,959 | 1/1985 | Lems | 53/384 X |

*Primary Examiner*—James F. Coan

*Attorney, Agent, or Firm*—Hill, Van Santen, Steadman & Simpson

[57] ABSTRACT

A method of easy opening bags, whereby longitudinal forces adapted to be applied at a force location intermediate the bag edges to at least one of the rib and groove elements of the bag tends to slide them relatively, and thereby effects curling of at least one of the rib and groove elements and separation of the elements from that interlock relation due to the resultant component of force in a direction tending to separate the rib and groove elements. Apparatus for this purpose is provided, especially suitable for use with a bag filling machine.

21 Claims, 10 Drawing Figures

FIG. 1
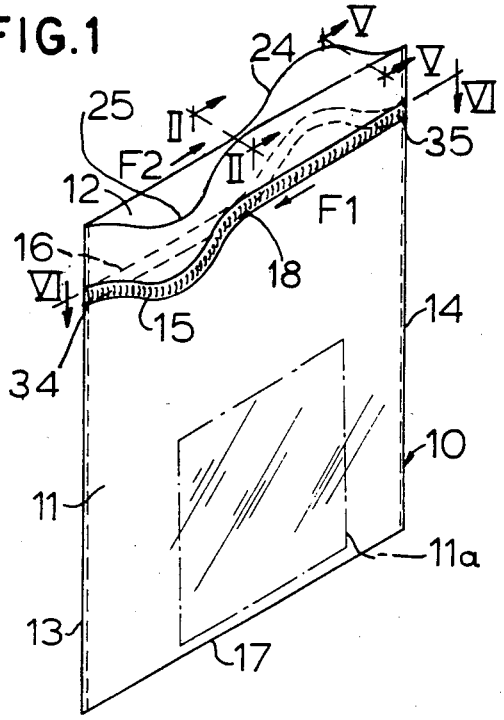
FIG. 2
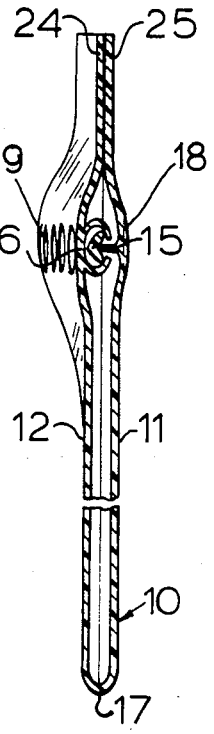
FIG. 6
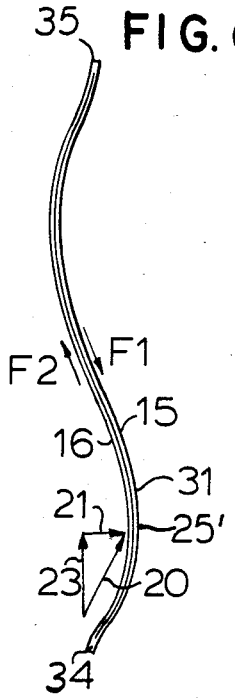
FIG. 4
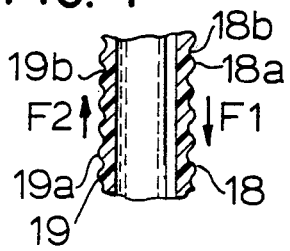
FIG. 3
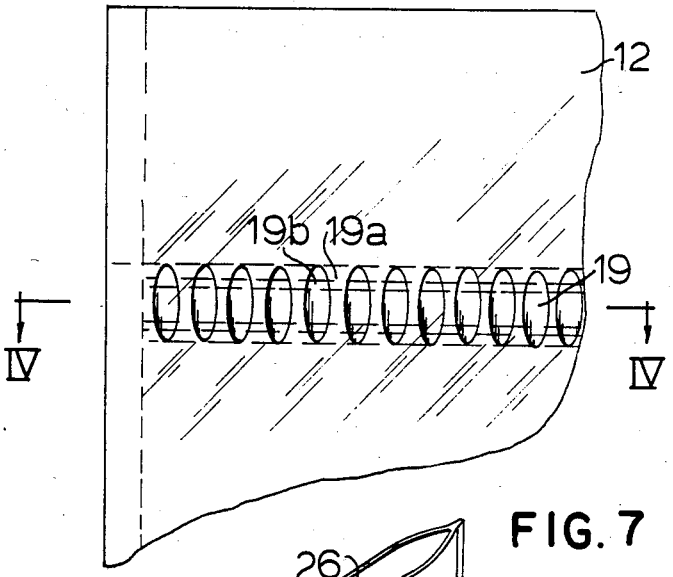
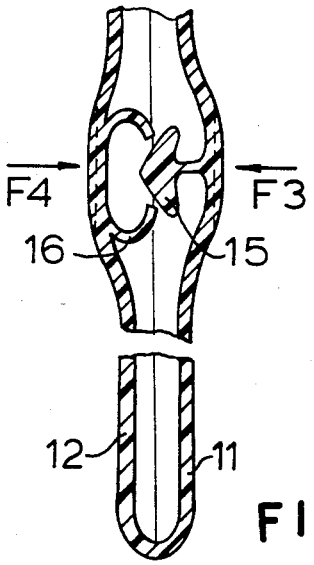
FIG. 5
FIG. 7
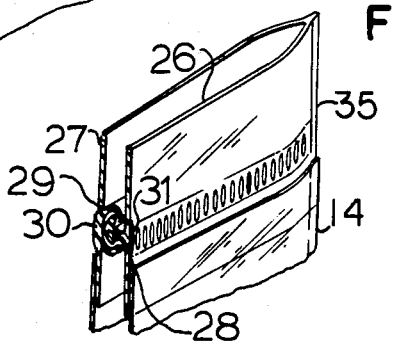

Drive
Control
Drive
FO
IX
IX

METHOD OF AND MEANS FOR EASY OPENING BAGS

PRIOR APPLICATION

This application is a continuation-in-part of my application Ser. No. 430,944 filed Sept. 30, 1982 now U.S. Pat. No. 4,479,244.

BACKGROUND OF THE INVENTION

The present invention relates to improvements in the art of plastic bag construction having a flexible fastener structure which incorporates pressure closable but reopenable rib and groove elements. More particularly, this invention relates to an improved method of and means for opening the fastener structure which eliminates the need for pulling apart opposing flaps as has heretofore been necessary.

Reclosable zipper lock plastic bags generally are formed of flexible thin plastic film with front and back walls attached to each other along their sides and along a bottom edge. The bag may be filled through the open bottom edge which is then sealed or may be filled through the top. Adjacent the top edge and extending fully across opposed confronting inner surfaces of the bag walls at the mouth of the bag are a pair of cooperatively interlocking fastener strip profiles formed with respective engageable rib and groove elements made of extruded plastic material. Examples of such bags and means of manufacture thereof are disclosed in U.S. Pat. Nos. 3,198,228, 2,780,261, Nos. RE 28,969, 3,054,434 and 3,340,116. Plastic bags may have the zipper lock rib and groove elements integral with the bags or these zipper lock elements may comprise separate fastener strips which are attached to the tops of bags. In either instance, the zipper lock rib and groove elements normally are extruded and are interlocked during manufacture for convenience of storage and handling. The rib and groove elements then must be separated for filling or for use. Typically, there are flange members extending above the rib and groove elements which flange members are gripped and pulled apart to separate the rib and groove for access to the interior of the bag.

Disadvantages are encountered in this manner of separating the rib and groove elements for opening the bag in that it is often difficult to find and grasp the separate flange elements particularly when the bag is formed of a very thin plastic film. Also, if it is intended that the bags are to be handled by a machine and opened by machine for mechanical handling and filling, it is difficult to provide machine elements which will find and grip the flanges and pull apart the rib and groove elements.

SUMMARY OF THE INVENTION

Accordingly, it is an object of the present invention to provide an improved method and apparatus whereby interlocked rib and groove bag closure elements may be separated rapidly and easily without the necessity of grasping the flanges to pull the rib and groove elements apart.

It is another object of the invention to provide a method of and apparatus for separating rib and groove elements rapidly by the application of simple mechanical force such as gripping the elements between relative moveable members and sliding the elements longitudinally relative to each other.

The method and apparatus of the present invention are adapted to be used with a reclosable bag construction having front and back walls attached by seams at their side edges. Continuous elongate interlocking separable rib and groove elements are provided along confronting faces at the top of the bag and the rib and groove elements may be attached to each other at the bag edges. The rib and groove elements as interlocked with each other may have a frictional surface means aligned therewith on the outer surface of said walls such as may be provided by a series of ridges extending transversely of the direction of the rib and groove elements. These frictional means facilitate the application of opposed longitudinal forces tending to slide the rib and groove elements in opposite directions, and this may be accomplished by mechanical means applying the opposed longitudinal forces at a force location which is generally at a suitable location intermediate the bag side edges. As the longitudinal forces are applied and the rib and groove elements tend to slide with respect to each other, at least one wall at the bag top will curl in a general S shape with a curvature away from the opposite wall. The resistance to curling or the beam strength of the rib and groove will cause a force component to be present laterally of the rib and groove elements which tends to separate the rib and groove elements and as the force is increased, the rib and groove elements will spring apart, thus achieving rapid separation. The principles described apply whether the rib and groove elements are integral with the bag or a part of fastener strips of the kind which can be attached to the top of a bag. Although a single rib and groove type fastener is shown, it will be appreciated that the principles of this invention are applicable to a multi-rib and groove fastener arrangement.

BRIEF DESCRIPTION OF THE DRAWINGS

Other objects, features and advantages of the present invention will be readily apparent from the following description of representative embodiments thereof, taken in conjunction with the accompanying drawings, although variations and modifications may be effected without departing from the spirit and scope of the novel concepts embodied in the disclosure, and in which:

FIG. 1 is a perspective view of a bag constructed in accordance with the principles of the present invention, illustrating the bag being opened in accordance with the method of the invention;

FIG. 2 is a vertical sectional view taken substantially along line II—II of FIG. 1;

FIG. 3 is a fragmentary enlarged view of a portion of the top of the bag of FIG. 1;

FIG. 4 is an enlarged fragmental sectional view taken substantially along line IV—IV of FIG. 3;

FIG. 5 is a fragmental vertical sectional view taken substantially along line V—V of FIG. 1;

FIG. 6 is a fragmentary somewhat schematic force diagram taken substantially along line VI—VI of FIG. 1;

FIG. 7 is a fragmentary perspective view of a modification showing preformed fastener strips attached to the bag walls, and embodying the principles of the present invention;

DESCRIPTION OF THE PREFERRED EMBODIMENTS

Figures 8, 9, 10:
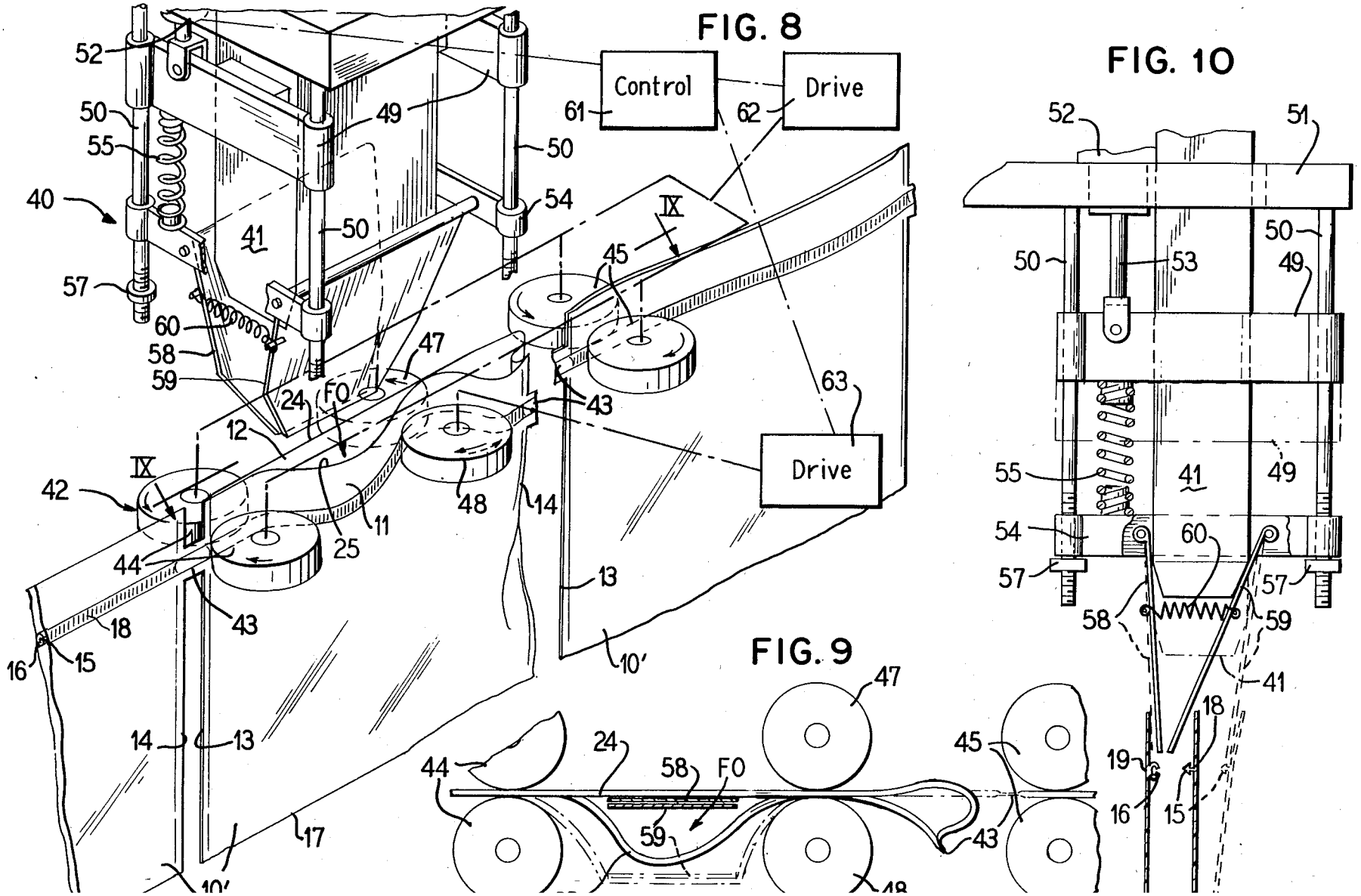
FIG. 8 is a schematic illustration of bag filling apparatus employing the principles of the present invention.
FIG. 9 is a schematic top plan view taken substantially along the line IX—IX of FIG. 8.
FIG. 10 is a fragmentary schematic side elevational view looking toward the right side of FIG. 8.

As illustrated in FIGS. 1 and 2, a bag 10 is formed of thin plastic film having a front wall 11 and a back wall 12. The walls are attached to each other at their side edges by seams 13 and 14, and the film is doubled at its lower edge 17 to form a closed bag with capabilities of holding contents such as shown schematically at 11*a*.

Adjacent to the top of the bag 10 are pressure closable interlocking releasable rib and groove elements with the rib element shown at 15 and the groove element at 16. The rib and groove elements are complementary in shape so that they are pressure closable by applying a lateral or normal force to the elements pressing them together.

In one form of manufacture, the bag film and the reclosable elements are manufactured at the same time, being extruded through a die, and the rib and groove elements 15 and 16 are pressed together to an interlocked relationship for storage and handling of the continuous strip of material. When the bags are formed, cross seams are formed to form the side edges 13 and 14 of the bags. The bags are normally formed from a tube which is slit to form the flanges 24 and 25 at the top of the bag. For opening the bag, heretofore, it was necessary to separate the flanges 24 and 25 and to grip them either by two hands between the thumb and forefinger or by mechanical means and pull the flanges apart to forcibly separate the rib 15 from the groove 16.

In accordance with the concepts of the present invention, the rib and groove elements are separated in order to open the bag by applying the opposing forces parallel to the fastener elements 15 and 16. These forces are shown at $F_1$ and $F_2$ in FIGS. 1, 4 and 6 and tend to slide the rib and groove elements longitudinally with respect to each other and to cause the fastener to curl as illustrated in FIG. 6.

For facilitating the application of the forces $F_1$ and $F_2$, the outer surfaces of the bag walls at the fastener elements 15 and 16 are roughened as shown at 18 and 19. The roughening provides a frictional surface means and, in a preferred form, is shown as vertical ridges 18*a* and 19*a* with valleys 18*b* and 19*b* therebetween. These ridges may be formed in the plastic when it is first extruded or may be formed by a mechanical compression device such as opposed ribbed wheels which deform the plastic to form the ribs 18*a* and 19*a*. While the roughened portion may be necessary only where the forces $F_1$ and $F_2$ are applied, for convenience, the roughened portion is continuous coextensive with the rib and groove elements.

For opening the bag, as illustrated in FIG. 1, the longitudinal forces $F_1$ and $F_2$ are applied in the directions tending to slide the rib and groove elements relative to each other. This may be done by applying a thumb and forefinger to the opposite sides of the bag and applying the forces in opposing directions along the fastener elements. The forces are preferably applied intermediate and spaced from the side seams 13 and 14. When the forces are applied, as illustrated in FIG. 6, and as also illustrated in FIG. 1, at least the top portion of one of the walls of the bag wall tend to curl. This is because the forces $F_1$ and $F_2$ are transmitted along the rib and groove elements to the ends of the rib and groove elements where they are attached to each other at 34 and 35 at the side edges of the bag. The force $F_2$ is transmitted along the groove 16 as indicated by the arrowed force vector 20. This vector has a force vector component 23, taken parallel to the plane of the bag, which tends to curl the bag wall and has a lateral component 21, taken at right angle to the rib and groove, which tends to separate the rib 15 from the groove 16. The stiffness of the joined rib and groove 15 and 16 may be referred to as the beam strength of the rib and groove elements, that is, their resistance to bending. The structure of the rib and groove elements is such that their resistance to bending is sufficiently great relative to the separation strength of the rib and groove elements so that they will not pop open, that is, separate, until the curvature reaches the general curvature shown in FIGS. 1 and 6. If the rib and groove are made of too soft a material so that they have a too small beam strength, or if the fastening strength of the rib and groove 15 and 16 is too great, the elements will not separate by the method herein described. The beam strength should be sufficiently strong so that the elements separate before the bag top ends curl into a semicircle. That is, before they curl so that the radius of curvature is approximately $\frac{1}{3}$ the width of the bag. Generally it has been found that by proper design of the rib and groove that a relatively strong closure can be provided and yet the closure will pop open with a relatively small curling of the top, as the forces $F_1$ and $F_2$ are applied, and the curvature will be generally such as that shown in FIG. 6 or possibly less. Putting it another way the rib and groove elements will separate when the vector force 21 created by forces $F_1$ and $F_2$ becomes greater than the interlocking strength of the hooks of the rib and groove.

It is also preferred that a plastic with a high slip be used for the rib and groove elements 15 and 16 so that they will not offer resistance to relative longitudinal movement as the forces $F_1$ and $F_2$ are applied.

FIG. 5 shows the rib and groove elements after they have been separated and are being reclosed. When separation has been accomplished by the ends popping open in the manner shown in FIG. 1, the operator can, if the bag is being manually manipulated, insert his finger down into either of the loops that have been created and separate the remaining interlocked portion which may be at the force location where $F_1$ and $F_2$ were applied by sliding his finger to the end of the bag. The bag can then be loaded or unloaded, and the fastener reclosed by applying lateral forces as shown by the forces $F_3$ and $F_4$ in FIG. 5. When the closing force is applied manually, this is usually done by pressing the fasteners together and then sliding the thumb and forefinger along the length of the rib and groove elements.

While the foregoing structure and operation has been described in connection with a bag where the fasteners or rib and groove elements are integral with the bag walls, the same principles may be applied to fastener strips. In fastener strips, two flat strip portions carry the rib and groove elements, and these strip portions are eventually attached to the top of or inside the walls of a bag. Such strips are shown at 26 and 27 in FIG. 7 with the rib element 28 on the strip 26 and the groove element 29 on the strip 27. The outer surfaces of the strips may have a frictional surface means at 30 and 31, respectively. The strips will have to be attached to each other at spaced locations, such as at 34 and 35 on the side seams 13 and 14, for the opening process so that forces in opposite directions can be applied parallel to the rib and groove elements to cause the curvature and the forced separation of the rib and groove elements.

In operation, with the structure shown in FIG. 1, the bag is received closed with the rib and groove elements 15 and 16 interlocked. The bag is opened by applying forces in the manual mode in the direction $F_1$ and $F_2$ such as by gripping between a thumb and forefinger and pushing in opposite directions parallel to the rib and groove elements. This will cause the ends of the bag to curl and the lateral separation force component shown at 21 in FIG. 6 will force the rib and groove elements apart opening the top of the bag as shown by the looped portions in FIG. 1. A finger can then be inserted into the looped portions to slidingly separate the fastener fully apart. For reclosing, pressure is applied along the rib and groove elements causing them to rejoin. Thus, it will be seen that we have provided an improved bag construction which provides for simple rapid opening, eliminating the need for fumbling and attempting to locate the separate flaps at the top and elinminating the need for using two hands to grip and pull the flaps apart.

While separation of the rib and groove elements may be accomplished by permitting the bag top to freely curl as illustrated in FIG. 6, lateral restraint may be applied to limit the amount of curling. For example, a lateral restraining force tending to prevent curling may be applied at 25' at the curl after the top has curled slightly such as an amount shown in FIG. 6. These lateral forces applied to limit the curling will augment the separation effects where fastener strips having a beam strength are used. By restraining the curl of the bag top, the excessive bending or curling of the top that might occur is prevented, and separation of the rib and groove elements is assured. While the force required to separate the rib and groove elements is determined by the design of the rib and groove itself, and a maximum strength closure should be provided for the bag which is being used, it is preferred that the rib and groove separate or open with a lateral force in the range of 2 to 7 pounds. The choice of this force needed to separate the rib and groove will be related to the beam strength of the combined rib and groove elements and whether the curling of the bag top will be restrained at the time the forces $F_1$ and $F_2$ are applied and to the slip content of the rib and groove elements.

While the bag closure arrangement is shown with a single rib element and a single groove element, in a preferred form, it will be understood that the principles of the invention can be utilized by a closure which has plural sets of matching ribs and grooves. For example, with reference to FIG. 2, instead of one rib 15, two ribs may be employed, and instead of one groove 16, two grooves may be employed. It is also possible to have a rib and groove on one wall of the bag and a corresponding matching rib and groove on the other wall of the bag.

While the opening of the bag has been described in connection with manual opening, the same principles are best utilized with the structure of the invention for mechanical opening using a force applying means that simulates the action of the thumb and forefinger in attempting to slide the rib and groove elements relative to each other in an axial direction.

Mechanical opening of the bags according to the principles of the present invention provides a useful technique for rapid opening, filling and thereafter closing of the bags, exemplified more or less schematically in FIGS. 8–10 in connection with a filling machine 40 which includes a filling nozzle 41 and mechanical means 42 for advancing and manipulating bags 10' for filling.

Preferably, the bags 10' may be supplied from a convenient source in the form of a continuous chain of bags wherein the bags 10' are connected one to the other by means of frangible fused links 43. While the bags may be in any edge-to-edge relation and separated except for the links 43, in a preferred arrangement, as shown, the bags are in spaced edge-to-edge relation with the bridging links 43 between the bags aligned with the separable fastener assembly 15, 16. The bags may otherwise be the same as described for the bag 10 in FIG. 1, that is, each bag having opposite wall panels 11 and 12, sealed seam side edges 13 and 14, a closed bottom 17 and, if desirable roughening 18 and 19 along the outside of the separate fastener elements 15 and 16, respectively.

Advance of the bags 10' along a bag-filling path aligned with the filling nozzle 41 is effected by the mechanical means 42 comprising a set of cooperating pinch rollers comprising a first set of two rolls 44 adapted to be driven synchronously in a stop and go fashion for advancing the bags 10' one at a time into position to be filled with product through the nozzle 41. Downstream from the filling location, a second set of two pinch rolls 45 synchronized with the rolls 44 is adapted for advancing filled bags along the said path. Intermediate the sets of pinch rolls 44 and 45 is another set of two cooperating pinch rolls 47 and 48 which in one phase of operation are adapted to operate in synchronism with the rolls 44 and 45 for advancing the bags, and in another phase of the operation adapted for applying relative opposing longitudinal force at a force location intermediate the bag edges to the rib and groove elements 15 and 16 tending to slide them longitudinally relative to one another thereby effecting curling of at least one of the interlocked rib and groove elements and their separation due to the resultant component of force tending to separate them. It will be observed, of course, that in the preferred arrangement, the sets of pinch rolls engage the bags along the rib and groove fastener assembly, and the rolls may have resilient driving perimeters for advantageously gripping the bag tops along the rib and groove fastener assembly, and more particularly the creating the roughening 18 and 19.

In the initial bag advancing phase of operation, all of the sets of rolls 44, 45 and 47–48 function in unison to advance the next succeeding bag into position under the filling nozzle 41. When the bag to be filled reaches the filling position, the rotary rolls are stopped and while the roll 47 remains stationary, together with the rolls 44 and 45, the roll 48 is rotated in reverse as indicated by the dashed arrow in FIG. 8 to apply the longitudinal force in opposing direction for curling the upper flange 25 and the associated portion of the fastener, namely, the rib portion 15 away from the opposite top flange portion of the bag, in the manner depicted in FIG. 8. This effects a filling opening in the top of the bag.

At the same time that the roll 48 warps or curls the bag to effect the opening FO, the portion of the downstream bag top flange 25 is caused to curl together with the attached portion of the top flange 24, thus applying a counterpulling force on the frangible link 43 connecting the bag to be filled with the previously filled bag which is being held stationary by the rolls 45. This breaks the link and separates the bag to be filled from the filled bag so that in the next advancing operation the previously filled bag will be ejected from the machine and the next filled bag will run into its place.

After the bag top flange 25 has been curled to provide the opening FO, the filling mechanism of the machine 40 is operated in coordinated relation. For this purpose, the filling nozzle 41 is mounted on a vertically reciprocable carriage 49 guided by depending guide rods 50 supported by a stationary machine frame 51 which carries an actuator 52 connected as by means of a piston or plunger rod 53 to the carriage 49. While the bag to be filled is advanced into filling position and the top curl opening FO is formed, the filling nozzle 41 is maintained by the actuator 52 in raised position clear of the bag. In coordinated relation with forming of the opening FO, the actuator 52 depresses the carrier 49, thus advancing the filing nozzle toward the top open bag to be filled. As the filling nozzle descends, a carriage 54 connected to the lower side of the carriage 49 as by means of combination tension and compression springs 55 is caused to descend from a raised position as shown in FIG. 8 to a lowered position as shown in FIG. 10 until the carriage 54 comes to a stop against limit stops 57 on the guide rods 50 and the carriage 49 continues moving the filling nozzle 41 downwardly through the carriage 54 so that normally closed spreader plates 58 and 59 depending pivotally from the carriage 54 are caused to enter at their lower ends into the open top of the bag to be filled, as shown in FIG. 10, and upon further descent of the carriage 49 and thus the nozzle 41, as permitted by the springs 55, the tip of the nozzle 41 causes the spreader plates 58 and 59 to spread apart as permitted by yieldable tension spring means 60 which normally pulls the plates 58 and 59 into the inactive or closed position. As the nozzle 41 descends and pushes the plates 58 and 59 apart, the opening FO is widened as indicated in dash outline in FIG. 9 to a maximum extent for efficient filling of contents into the bag from the nozzle 41, from a product supply (not shown). As soon as the product has been deposited in the bag, the actuator 52 reverses and raises the carriage 49 and thereby the carriage 54 to clear the filling nozzle and the spreader plates from the filled bag. As the top of the bag is closed, all three of the sets of rolls 44, 45 and 47, 48 operate in unison to advance the bags, the previously filled bag being ejected from the machine and the freshly filled bag being advanced on through the rolls 45. As this action takes place, the fastener assembly which had been separated in forming the opening FO is reclosed by the rolls 45 and the rolls 47, 48.

Cyclical operation of the filling machine 40 is adapted to be controlled from a control module 61 which controls a driving means such as a motor 62 for unison driving of the rolls 44, 45 and 47, and also controls driving means such as a reversable motor 63 for reversably driving the roll 48. In addition, the control module 61 is adapted to control the actuator 52 in coordinated relation with operation of the sets of rolls. Further, the control module may be in control of the product supply for the filling nozzle 41. The operating controls have been indicated schematically because such controls are well known and do not per se form part of the present invention.

It will be understood that variations and modifications may be effected without departing from the spirit and scope of the novel concepts of this invention.

I claim as my invention:

1. The method of opening a bag top closed by reclosable interlocked rib and groove elements extending between opposite side edges of the bag along the confronting faces of the bag walls at the bag top, which comprises the steps:

applying longitudinal force adjacent one of the bag side edges to at least one of the rib and groove elements while holding the rib and groove elements adjacent to the other of said side edges and tending to slide said rib and groove elements relatively; and thereby effecting curling of said at least one of the rib and groove elements and separation of the elements from their interlocked relation due to the resultant component of force in a direction tending to separate the rib and groove elements.

2. A method according to claim 1, which comprises effecting relative longitudinal movement of both of said rib and groove elements and curling and separation of the elements adjacent to both of said bag sides.

3. A method according to claim 1, which comprises advancing the bag between sets of spaced cooperatively rotatable pinch rolls, and while holding the bag adjacent to said other side by certain of said pinch rolls relatively rotating another set of said pinch rolls adjacent to said one side of the bag for effecting said curling and separation of the rib and groove elements.

4. A method according to claim 3, which comprises by means of said pinch rolls engaging frictional surface means at the outer surfaces of said walls at the rib and groove elements and thereby facilitating gripping and applying of local force along the rib and groove elements by said pinch rolls.

5. A method according to claim 1, which comprises applying said longitudinal force between relatively rotary sets of pinch rolls adjacent to said opposite sides of the bag and between which said elements are engaged in a bag filling machine.

6. A method according to claim 5, which comprises aligning filling means between said sets of rolls with an opening provided in the bag top by the curling and separation of said rib and groove elements.

7. A method according to claim 1, which comprises providing said rib and groove elements with a longitudinal beam strength resistant to bending sufficiently great relative to the separation tendency of the rib and groove elements so that upon the application of said longitudinal force and curling of said at least one of the rib and groove elements the resistance to curling by said beam strength will cause the rib and groove elements to separate.

8. The method of opening a bag top closed by reclosable interlocked rib and groove elements extending between side edges of the bag along the confronting faces of the bag walls at the bag top, which comprises the steps:

applying manual digital force to said elements and thereby applying longitudinal force at a force location intermediate the bag edges to at least one of the rib and groove elements tending to slide them relatively; and thereby effecting curling of said at least one of the rib and groove elements and separation of the elements from their interlocked relation due to the resultant component of force in a direction tending to separate the rib and groove elements.

9. The method of opening a bag top closed by reclosable interlocked rib and groove elements extending between side edges of the bag along the confronting faces of the bag walls at the bag top, which comprises the steps:

applying longitudinal force at a force location intermediate the bag edges to at least one of the rib and groove elements tending to slide them relatively;

thereby effecting curling of said at least one of the rib and groove elements and separation of the elements from their interlocked relation due to the resultant component of force in a direction tending to separate the rib and groove elements; and providing said rib and groove elements with a longitudinal beam strength resistant to bending sufficiently great relative to the separation tendency of the rib and groove element so that upon the application of said longitudinal force and curling of said at least one of the rib and groove elements the resistance to curling by said beam strength will cause the rib and groove elements to separate.

10. A method of opening a bag top closed by reclosable interlocked rib and groove elements extending between side edges of the bag along the confronting faces of bag walls at the bag top and the ends of said rib and groove elements being fixedly secured together at said side edges, there being friction surface means at the outer surface of said walls at the rib and groove elements, and said rib and groove element having a longitudinal beam strength generally resistant to bending sufficiently great to avoid unintentional separation of the rib and groove elements, the method comprising:

engaging said frictional surface means adjacent to the opposite side edges and applying longitudinal force toward a force location intermediate the bag edges to at least one of the rib and groove elements tending to move them slidably relatively in longitudinal direction; and thereby effecting curling of said at least one of the rib and groove elements and separation of the elements from their interlocked relation in opposition to said beam strength and due to a resultant component of force in a separating direction.

11. A method according to claim 10, which comprises moving both of said rib and groove elements relative to one another in effecting said curling and separation.

12. A method according to claim 10, which comprises holding the other of said rib and groove elements fixedly while relatively moving said one of said rib and groove elements longitudinally and effecting said curling and separation.

13. Apparatus for opening a bag top closed by reclosable and interlocked rib and groove elements extending between side edges of the bag along the confronting faces of the bag walls at the bag top, comprising:

means for applying longitudinal force adjacent one of the bag edges to at least one of said rib and groove elements and means for holding the rib and groove elements adjacent the other of said side edges for thereby tending to effect relative longitudinal movement of said rib and groove elements; and said means being effective to curl said at least one of the rib and groove elements and thereby causing separation of the elements from their interlocked relation due to the resultant component of force in a direction tending to separate the rib and groove elements.

14. Apparatus according to claim 13, wherein said means comprises spaced members for holding said one of said rib and groove elements, and a member for effecting longitudinal movement of the other of said rib and groove elements relative to said one of said rib and groove elements.

15. Apparatus according to claim 14, wherein said spaced members comprise sets of cooperative rolls adapted in one mode of operation to effect advance of the bag in a working path, and operative in a second mode of operation for effecting said relative longitudinal movement of the rib and groove elements.

16. Apparatus according to claim 15, including means for controlling said rolls for effecting bag advancing rotation of the rolls in said one mode of operation, and for maintaining one of said rolls stationary while driving the other of said rolls in reverse in said second mode of operation.

17. Apparatus according to claim 13, wherein said means comprises part of a bag filling machine, and said means being operative to effect said curling and separation and thereby opening of the bag in registration with means located between said force applying means and said holding means for filling the bag.

18. Aparatus according to claim 17, including spreader plate means coordinating with and operated by a nozzle of said bag filling means for increasing the bag opening for facilitating filling.

19. Apparatus according to claim 13, wherein said means comprises part of mechanism for handling said bag as one of a chain of bags, and means for holding said chain of bags stationary while said curling and separation are effected and said curling and separating means being simultaneously operative for effecting separation of the immediately preceding bag from the bag on which said rib and groove elements are relatively curled and separated.

20. Apparatus according to claim 19, wherein said holding means comprise pinch rollers engaging said bags.

21. Apparatus for opening a bag top closed by reclosable and interlocked rib and groove elements extending between side edges of the bag along the confronting faces of the bag walls at the bag top, comprising:

means for applying longitudinal force at said force location intermediate the bag edges to at least one of said rib and groove elements tending to effect relative longitudinal movement thereof;

said means being effective to curl said at least one of the rib and groove elements and thereby causing separation of the elements from their interlocked relation due to the resultant component of force in a direction tending to separate the rib and groove elements;

said means comprising a member for holding one of said rib and groove elements, and a member for effecting longitudinal movement of the other of said rib and groove elements relative to said one of said rib and groove elements;

said members comprising cooperative rolls adapted in one mode of operation to effect advance of the bag in a working path, and operative in a second mode of operation for effecting said relative longitudinal movement of the rib and groove elements; and means for controlling said rolls for effecting bag advancing rotation of the rolls in said one mode of operation, and for maintaining one of said rolls stationary while driving the other of said rolls in reverse in said second mode of operation.

* * * * *